US011841021B2

(12) United States Patent
Foote et al.

(10) Patent No.: US 11,841,021 B2
(45) Date of Patent: Dec. 12, 2023

(54) TEMPERATURE CONTROL OF A PUMPED GAS FLOW

(71) Applicant: Edwards Limited, Burgess Hill (GB)

(72) Inventors: William Foote, Burgess Hill (GB); Stephen Dowdeswell, Burgess Hill (GB); David Bedwell, Burgess Hill (GB); Simon Stevens, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 460 days.

(21) Appl. No.: 16/631,630

(22) PCT Filed: Feb. 28, 2018

(86) PCT No.: PCT/GB2018/050525
§ 371 (c)(1),
(2) Date: Jan. 16, 2020

(87) PCT Pub. No.: WO2019/016499
PCT Pub. Date: Jan. 24, 2019

(65) Prior Publication Data

US 2020/0173444 A1 Jun. 4, 2020

(30) Foreign Application Priority Data

Jul. 19, 2017 (GB) ..... 1711630

(51) Int. Cl.
*F04C 29/04* (2006.01)
*F04C 25/02* (2006.01)
(Continued)

(52) U.S. Cl.
CPC ..... *F04C 29/04* (2013.01); *F04C 25/02* (2013.01); *F28D 1/02* (2013.01); *F28D 7/1669* (2013.01);
(Continued)

(58) Field of Classification Search
CPC ..... F28D 1/02; F28D 2001/0273; F28D 2001/026; F28D 2021/0029; F28D 7/1669;
(Continued)

(56) References Cited

U.S. PATENT DOCUMENTS 2,405,722 A * 8/1946 Villier ..... F28F 1/14 165/181
2,906,448 A * 9/1959 Lorenz ..... F04C 29/068 165/47
(Continued)

FOREIGN PATENT DOCUMENTS

CN 1682021 A 10/2005
CN 104169671 A 11/2014
(Continued)

OTHER PUBLICATIONS

Combined Search and Examination Report under Sections 17 and 18(3) dated Dec. 20, 2017 in counterpart EP Application No. 1711630.2, 9 pp.
(Continued)

*Primary Examiner* — Devon Russell
(74) *Attorney, Agent, or Firm* — Shumaker & Sieffert, P.A.

(57) ABSTRACT

A heat exchanger for changing a temperature of a pumped gas flow and a pump comprising the heat exchanger is disclosed. The heat exchanger comprises: at least one tube configured to contain a flow of fluid; said at least one tube being at least partially embedded within a block of material; wherein said heat exchanger comprises mounting means configured to mount said heat exchanger adjacent to a gas port of a pump such that a least a portion of said heat exchanger extends into a path for gas flow flowing through said gas port; wherein the mounting means comprises a flange, the flange being configured to connect with the gas
(Continued)

port of the pump, the block being mounted to the flange such that the block extends towards the rotor of the pump when the flange is connected with the gas port of the pump.

19 Claims, 3 Drawing Sheets

(51) Int. Cl.

| | |
|---|---|
| ***F28D 1/02*** | (2006.01) |
| ***F28D 7/16*** | (2006.01) |
| ***F28F 1/20*** | (2006.01) |
| *F01C 21/10* | (2006.01) |
| *F04B 53/08* | (2006.01) |
| *F04C 18/12* | (2006.01) |
| *F04D 29/58* | (2006.01) |
| *F28D 21/00* | (2006.01) |

(52) U.S. Cl.
CPC ..... *F28F 1/20* (2013.01); *F01C 21/10* (2013.01); *F04B 53/08* (2013.01); *F04C 18/126* (2013.01); *F04C 2240/20* (2013.01); *F04C 2240/40* (2013.01); *F04D 29/5826* (2013.01); *F28D 2001/026* (2013.01); *F28D 2001/0273* (2013.01); *F28D 2021/0029* (2013.01)

(58) Field of Classification Search
CPC ..... F28D 1/0472; F28D 2001/0266; F28D 2001/0293; F28F 1/20; F04B 53/08; F04D 29/5826
See application file for complete search history.

(56) References Cited

U.S. PATENT DOCUMENTS

| | | | | |
|---|---|---|---|---|
| 4,010,016 | A | 3/1977 | Haugen | |
| 4,782,892 | A * | 11/1988 | Ostbo | F28F 7/02 165/DIG. 397 |
| 4,859,158 | A * | 8/1989 | Weinbrecht | F04C 29/042 418/206.4 |
| 5,439,358 | A * | 8/1995 | Weinbrecht | F04C 29/042 418/206.4 |
| 6,312,240 | B1 * | 11/2001 | Weinbrecht | F04C 29/122 418/206.4 |
| 9,909,812 | B2 | 3/2018 | Peskos et al. | |
| 2004/0055740 | A1 * | 3/2004 | Meshenky | F02B 37/013 165/125 |
| 2005/0058535 | A1 * | 3/2005 | Meshenky | F28F 13/06 415/121.3 |
| 2008/0289338 | A1 * | 11/2008 | Desai | F04C 14/02 60/734 |
| 2015/0129183 | A1 | 5/2015 | Peskos et al. | |

FOREIGN PATENT DOCUMENTS

| | | | | |
|---|---|---|---|---|
| CN | 104395683 | A | 3/2015 | |
| CN | 204941966 | U | 1/2016 | |
| CN | 206035770 | U | 3/2017 | |
| DE | 102006011062 | A1 * | 9/2007 | F01D 9/026 |
| DE | 102006011062 | A1 | 9/2007 | |
| EP | 0636789 | A1 | 2/1995 | |
| EP | 1832754 | A2 * | 9/2007 | F01D 9/026 |
| EP | 1832754 | A2 | 9/2007 | |
| GB | 1510403 | A * | 5/1978 | F04D 25/163 |
| GB | 1510403 | A | 5/1978 | |
| JP | S59185883 | A | 10/1984 | |
| WO | 2017187046 | A1 | 11/2017 | |

OTHER PUBLICATIONS

Combined Search and Examination Report under Sections 17 and 18(3) dated Oct. 26, 2018 in counterpart EP Application No. 1807017.7, 8 pp.
International Search Report and Written Opinion dated May 9, 2018 in counterpart International Application No. PCT/GB2018/050525, 13 pp.
First Office Action and Search Report, and translation thereof, from counterpart Chinese Application No. 201880047979.4, dated Apr. 2, 2021, 15 pp.
Busch Vacuum, "Booster Vacuum Pumps", Busch Group, 2023, 4 pp., Retrieved from the Internet on Jan. 4, 2023 from URL: https://www.buschvacuum.com/uk/en/products/vacuum-pumps/booster/booster-technology/.

* cited by examiner

TEMPERATURE CONTROL OF A PUMPED GAS FLOW

This application is a national stage entry under 35 U.S.C. § 371 of International Application No. PCT/GB2018/050525, filed Feb. 28, 2018, which claims the benefit of GB Application 1711630.2, filed Jul. 19, 2017. The entire contents of International Application No. PCT/GB2018/050525 and GB Application 1711630.2 are incorporated herein by reference.

TECHNICAL FIELD

The disclosure relates to pumped gases and in particular, to using a heat exchanger to change the temperature of a gas flow being pumped.

BACKGROUND

The temperature of a gas that is being pumped can have a significant effect on the pumping process. In this regard, it may be important that the temperature of the gas does not fall below a certain critical value where for example, the gas being pumped has constituent components liable to condense. In other circumstances it may be important to keep the temperature of the gas low as this improves pumping efficiency. Furthermore, where the pump is manufactured with close tolerances then undue temperature increases within the pump can cause operational difficulties and may result in the pump seizing.

Providing effective temperature control to gases being pumped can be problematic. Gases being pumped are confined within a pumping chamber and thus, it may be difficult to provide effective heat transfer to the gas itself. Furthermore, the components of the pump are generally manufactured to high tolerances, and trying to control the gas temperature by heating or cooling the external surfaces of the pump, can result in large variations in temperature between the internal and external components which will result in differential expansion between the components.

It would be desirable to be able to provide effective temperature control of a pumped gas flow.

SUMMARY

A first aspect of the present disclosure provides a heat exchanger for changing a temperature of a gas flow, said heat exchanger comprising at least one tube configured to contain a flow of fluid; said at least one tube being at least partially embedded within a block of material; and mounting means configured to mount said heat exchanger adjacent to a gas port of a pump such that a least a portion of said heat exchanger extends into a path or passage for gas flow flowing through said gas port; wherein said mounting means comprises a flange, said flange being configured to connect with said gas port of said pump, said block being mounted to said flange such that said block extends towards said rotor of said pump when said flange is connected with said gas port of said pump such that said heat exchanger.

The inventors of the present disclosure recognised that providing a heat exchanger configured so that when it is mounted on a pump at least a portion of the heat exchanger extends into a path for the gas flowing either into or out of the port, is a much more effective way of managing the temperature of the gas than mounting a heat exchanger such that it contacts the external surfaces of the pump. However, they also recognised that conditions within the gas flow can be challenging to a heat exchanger and that where a fluid is used in a heat exchange it is very important that there is no leakage of that fluid into the gas flow leading to contamination of that gas flow.

In order to protect the tube(s) carrying the heat exchange fluid from the vibrations due to the gas flow and the rotation of the rotor, the inventors have provided a heat exchanger where the pipes are held rigidly by embedding them at least partially within a block of material. In this way each tube is held in position along at least sections of its length, such that the tube is protected from vibrations from the motor and gas flow and these are not imparted to the tubes. This mounting along the length of the pipes by at least partially embedding them within the block, means that movement is resisted along their length and this impedes any vibrations from manifesting themselves in the tubes and reduces the wear on the tubes. This protects the tubes from fatigue which might result from the tubes vibrating which in turn can lead to leakage of the heat exchange fluid. The block is formed of a rigid, conductive material that is operable to hold and protect the pipes and conduct heat between them and the gas flow into which at least a portion of the heat exchanger extends. The block can be formed of any shape suitable for mounting onto the pump.

Furthermore, providing the heat exchanger such that the block extends towards the rotor is particularly advantageous as this allows the heat exchanger to be close to the port and close to the rotor so that the cooling or heating effects seen from the heat exchanger not only affect the temperature of the gas passing over the heat exchanger, but also any gas which is not exhausted from the pump. Where the heat exchanger is a cooler, this leads to further cooling of the gas and reduces the temperature of the rotor.

It should be noted that the gas port may be a gas inlet or gas exhaust of a pump, or where the pump is a multi-stage pump it may be the port between the stages. The mounting means is such that it is mounted adjacent to such a port such that it extends into a gas flow path and in operation of the pump gas flows over at least a portion of the heat exchanger, this direct contact resulting in an improved heat exchange between the gas and the heat exchanger resulting in improved temperature control of the gas.

In some embodiments, said heat exchanger comprises a plurality of heat transfer fins extending from said block, said plurality of heat transfer fins being configured to extend into said gas flow path when said heat exchanger is mounted adjacent to said gas port.

It should be noted that the heat transfer fins may be any type of protrusion extending from the block to increase the heat transfer surface area of the heat exchanger. They may be a line of adjacent rectangular protrusions as in many conventional heat exchangers or they may be differently shaped protrusions adapted to the geometry of the gas flow path in which they are to be sited.

Where the block comprises heat transfer fins, then in some embodiments, both the heat transfer fins and block extend towards the rotor.

In some embodiments said block and fins are shaped to be in close proximity to said rotor when said flange is connected with said gas port of said pump.

In some embodiments said block and fins are shaped such that said block and fins extend further towards said rotor towards a centre of said gas flow path than they do towards an edge of said gas flow path.

In some embodiments, both the heat exchange fins and the block are wholly mounted within the gas flow path when the heat exchanger is mounted in its operation position adjacent to the gas port of the pump.

In some embodiments, said block is configured such that said block and heat transfer fins extend substantially across a whole cross section of said gas port.

It may be advantageous to configure the heat exchanger such that it has substantially the same cross section perimeter as the gas port. In such a case, the heat exchanger may have an outer perimeter that is of a length that is 90% or more of the length of the perimeter of the gas port and adjacent gas flow passage in use.

In some embodiments, said heat exchanger is configured to be mounted centrally within said gas flow path when mounted adjacent to said port of said pump.

It may be advantageous to mount the heat exchanger centrally in the gas flow path to improve heat transfer between the gas flow and the heat exchanger.

In some embodiments, said block and said plurality of heat transfer fins are formed of a plurality of modules attached together.

Although the block and fins may be built of a single unit, in some embodiments they are formed of a plurality of modules that are held together in some way, perhaps using bolts. This provides a cost effective way of constructing the heat exchanger from what may be off-the-shelf parts and yet which still provides an effective means of managing the temperature of the pumped gas flows.

In some embodiments, said plurality of heat transfer fins are formed of a plurality of modules and said bock comprises one module, said plurality of fin modules being attached to said block module.

Where the heat exchanger is formed of a plurality of modules, then it may be that the block is formed of one module and the fins are formed of other modules or it may be that the block itself is formed of a plurality of modules that are perhaps bolted together with the fins bolted onto the individual blocks. In this regard, the blocks are a block of material that have the pipes for the heat transfer fluid mounted at least partially within them. The block may be of any shape suitable for mounting to the pump port. The block may be a solid block or it may be a block with holes extending therethrough.

Although the block may be formed of a number of materials, provided that it has a relatively high conductivity and as such can transfer heat between its outer surface and the liquid in the tubes, in some embodiments, both the block and the heat transfer fins are formed of cast metal.

Cast metal is a solid and robust material that is relatively cheap to manufacture and has the required properties for an effective heat exchanger. Furthermore, it provides a rigid support for the tubes and protects them from the vibrations due to the pump's operation.

In some embodiments, said block and heat transfer fins are formed as a cast metal unit.

As noted previously, the block and heat transfer fins may be formed as modules; alternatively, they may be formed as single cast metal unit. Such a cast metal unit may be configured to be adapted to the gas flow path where it is to be sited and in this way, may cover much of the path and extend close to the rotor providing effective heat transfer to the gas flow.

The cast metal may be a number of different metals but in some embodiments it comprises aluminium. Aluminium has a good thermal conductivity, is relatively light and relatively cheap and easy to cast.

Although the tubes can be formed of a number of materials, in some embodiments they are formed of a metal. Metal is again a suitable material having a high thermal conductivity and allowing effective heat transfer between the heat exchange fluid, often a liquid, and the rest of the heat exchanger and being robust and able to withstand the operational environment of the pump. In some cases, the metal is either stainless steel or copper.

The tubes may be formed in a number of ways and in some embodiments, they are cast within the block which provides a particularly rigid support for the tubes and allows for good thermal conductivity between the tubes and the blocks. Alternatively, the tubes may be pressed into the block. This may be an easier way to manufacture the tubes and can provide an effective mounting of the tubes. Where the tubes are pressed into the block, it may be advantageous to mount a conductive film between the tubes and the block. Such a conductive film should be of a deformable material such that the tubes when pressed into the block deform the film and any air gaps which would reduce thermal conductivity are removed or at least reduced.

In some embodiments, said mounting means comprises a flange, said block being mounted to said flange and said flange being configured to connect with said gas port of said pump.

The heat exchanger may be mounted to the gas port of the pump via a flange and may be mounted such that it is close to the gas port and provides effective heat exchange with the gas either exiting or entering the port.

In some embodiments, said block is mounted to said flange and is configured such that when mounted adjacent to said pump port at least some of said plurality of heat transfer fins extend close to at least one rotor of said pump, such that said plurality of heat transfer fins are within 50 mm, preferable within 10 mm and more preferable within 5 mm of said rotor.

As noted previously, by mounting the heat exchanger close to the port, effective heat transfer to the gas is provided. Providing it close to the rotor or rotors may be particularly advantageous as each time the pump rotates there will be some gas that is not exhausted from the pumping chamber but which circulates again with the rotor. Where the heat exchanger is close to the port and close to the rotors, then the cooling or heating effects seen from the heat exchanger will not only affect the temperature of the gas passing over the heat exchanger, but also that gas which is not exhausted from the pump. This leads to further cooling of the gas and reduces the temperature of the rotor or rotors.

In some embodiments, said mounting means comprises a fluid inlet and outlet for connecting to a fluid source. ¶The tubes within the heat exchanger are configured for heat transfer fluids to flow through them, and where the heat exchanger is a cooler, these will be coolant fluids and where the heat exchanger is to provide warming of the gases, they may be warmed fluids. In order for them to flow into and out of the heat exchanger during use, a fluid inlet and outlet for connecting to a fluid source is required and these may be on the mounting means of the heat exchanger allowing for easy access to the tubes by the fluid source.

In some embodiments, said heat exchanger comprises a cooler, and said flow of fluid comprises a flow of cooling fluid.

It may be advantageous to cool a pumped gas. When pumping a gas, the operation of the pump will heat the gas and this will cause it to expand. This may affect the efficiency of the pump and may also cause problems for the pump itself due to expansion of the rotors as they heat up, which where the pump is manufactured with tight tolerances, can lead to the pump seizing. Thus, in many situations it may be advantageous to provide cooling to the pump and providing cooling within the pump itself, such that the flow of gas contacts at least a part of the heat exchanger and is cooled by it is a particularly effective way of providing cooling to that gas flow.

In other embodiments, said heat exchanger comprises a heater and said flow of fluid comprises a flow of warmed fluid.

There are situations where the gases being pumped need to be kept above a certain temperature which may be important where condensation, for example, is to be avoided. Heat exchangers according to embodiments can be used with warmed fluid within the tubes to provide effective warming of the gas flow.

A second aspect of the present disclosure provides a pump comprising a heat exchanger according to a first aspect of the present disclosure, said heat exchanger being mounted adjacent to a port of at least one stage of said pump such that at least a portion of said heat exchanger extends into a flow of gas passing through said port.

In some embodiments, said heat exchanger comprises a cooler and said pump comprises a booster pump, said heat exchanger being mounted adjacent to the exhaust of said booster pump.

One field where embodiments are particularly effective is in the field of booster pumps where it may be advantageous if the gas being supplied to the further pump is not too hot. In effect the heat exchanger acts as an aftercooler that removes heat from the compressed exhaust gas of a vacuum booster pump. This enhances the booster's thermal performance especially in harsh processes with high motor powers and large gas loads, which might otherwise result in rotor to stator contact and potential seizure. The cooler also lowers the heat load from the gas stream entering the final stage backing vacuum pump.

In some embodiments, said pump comprises a vacuum booster pump where at least a portion of said gas is recirculated, said heat exchanger being arranged to provide cooling to both said exhausted and recirculated gas.

The pumping mechanism of a vacuum booster pump such as a Roots vacuum booster pump is such that there is not 100% efficiency in exhausting the gas through the pump outlet such that some of the gas being pumped from the inlet to the outlet will continue round with the rotors and be recirculated. The arrangement of embodiments where the heat exchanger is mounted to extend towards the rotor of the pump provides cooling not only to the gas that is exhausted but also to the gas that does not exit but is recirculated. This cooling of the recirculating gas provides effective cooing of the rotors and the pump itself Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings, in which.

DETAILED DESCRIPTION

Before discussing the embodiments in any more detail, first an overview will be provided.

A heat exchanger for pumped gases is provided. The heat exchanger is configured for mounting at a gas port of a pump such that it warms or cools the gas flowing through that port. The heat exchanger is configured so that at least a part of the heat exchanger and in some embodiments all of the heat exchanger is mounted within the gas flow, allowing for effective heat transfer between the heat exchanger and the gas. The tubes carrying the flow of heat exchange fluid are protected from the vibrations of the pump and the potentially harsh environment of the gas flow by being at least partially embedded in a block of material, which block provides rigid support for the pipes along at least 80% of the length of the pipes. This provides an effective yet compact arrangement.

In some embodiments at least 80% of the cross section of the pipes are held within the block.

The block may be of cast metal and in some embodiments has protrusions extending from the block supporting the pipes which protrusions or fins extend into the gas flow and increase heat exchange.

The tubes may be cast within the block or pressed into it. In some cases the heat exchanger may be formed of modules, the tubes being supported by being pressed into block modules, which block modules have heat exchange fin modules bolted to them.

Figure 1:
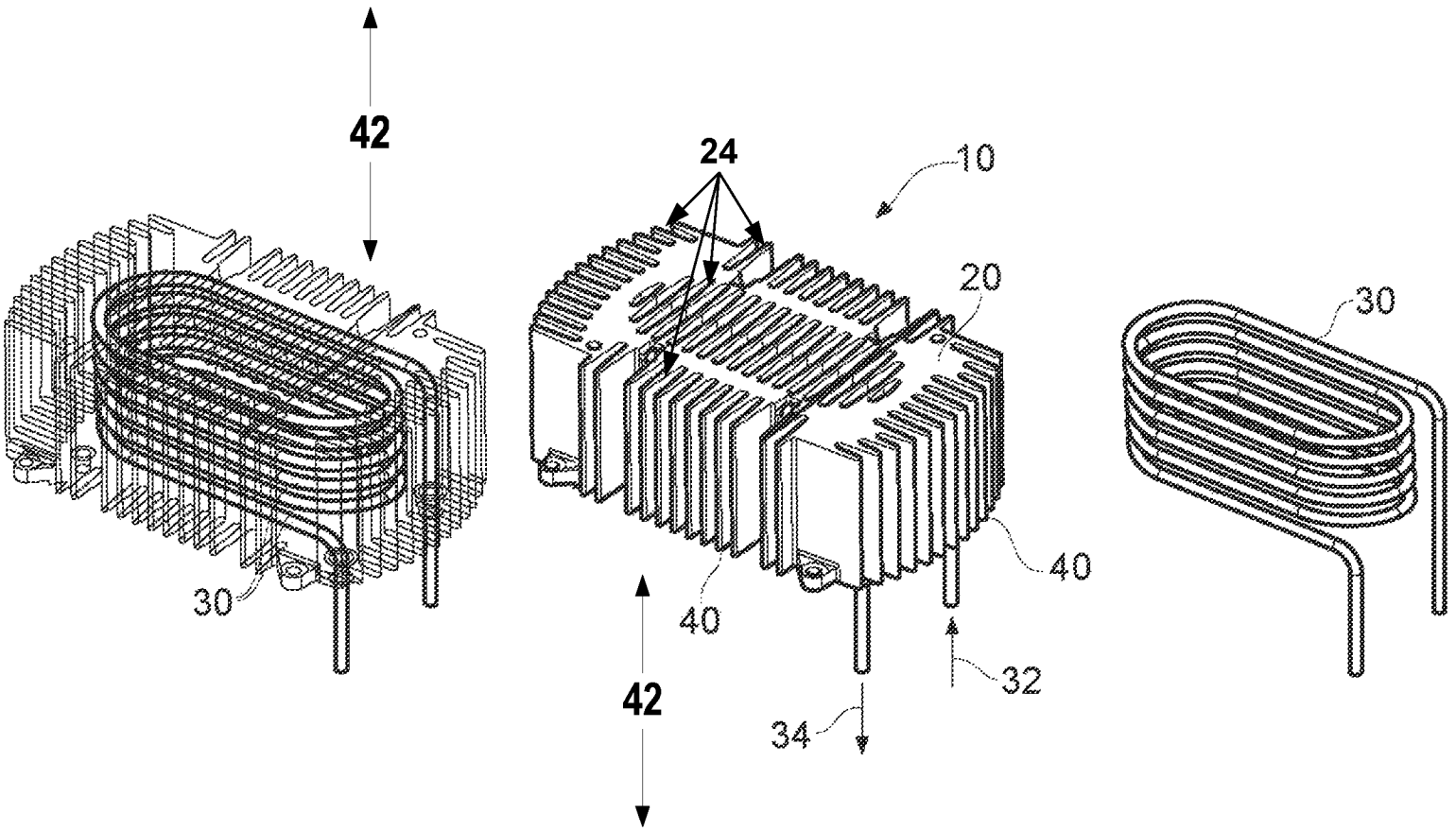
FIG. 1 illustrates a heat exchanger block and tubes according to an embodiment.

FIG. 1 shows a heat exchanger 10 formed of cast metal according to an embodiment. The main block 20 has tubes 30 (shown separately) cast within the block, which tubes have an inlet 32 and outlet 34 for connection to a fluid source, allowing fluid to flow around the tubes within the heat exchanger.

The cast metal heat exchanger 10 has a central block 20 in which the pipes are cast and heat exchange fins or protrusions 40 around the edge which increase the contact surface area with the gas flow 42. The central portion of the block 20 has through passages 24 allowing for the flow 42 of gas.

Figure 2:
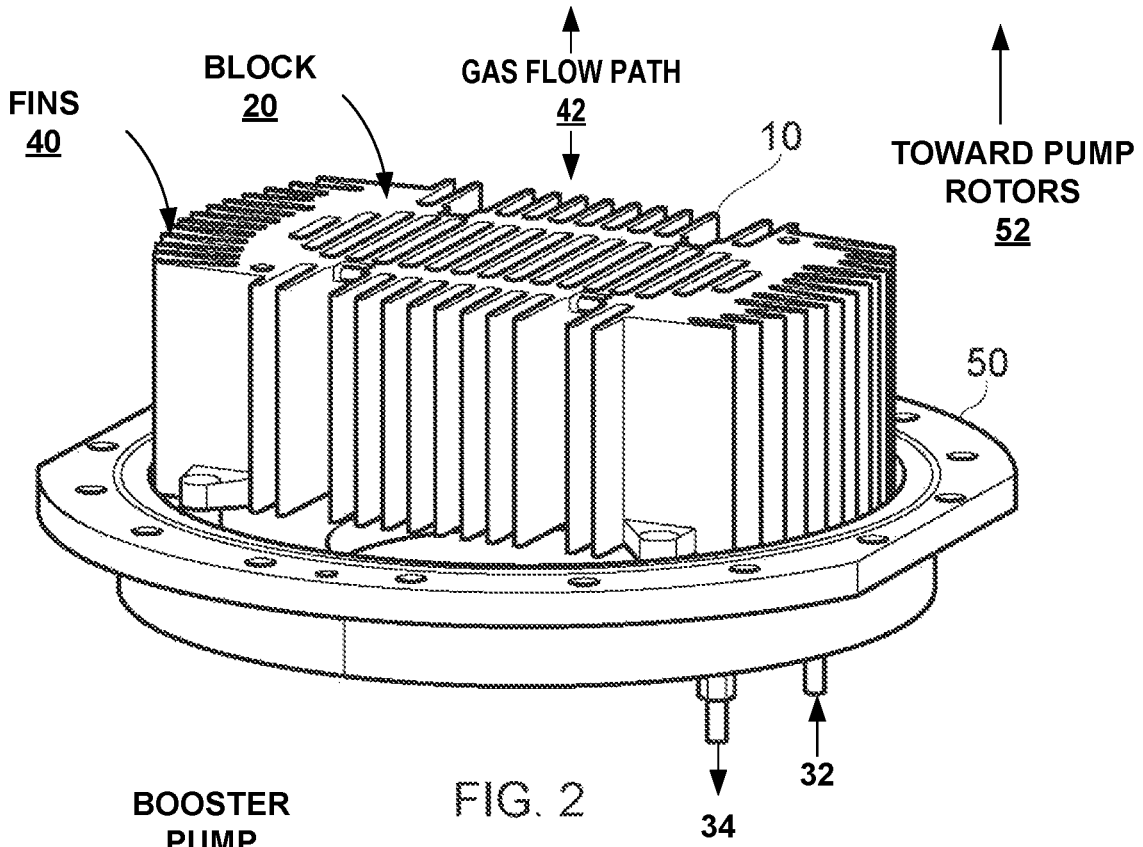
FIG. 2 illustrates the heat exchanger of FIG. 1 with mounting flange according to an embodiment.
Figure 3:
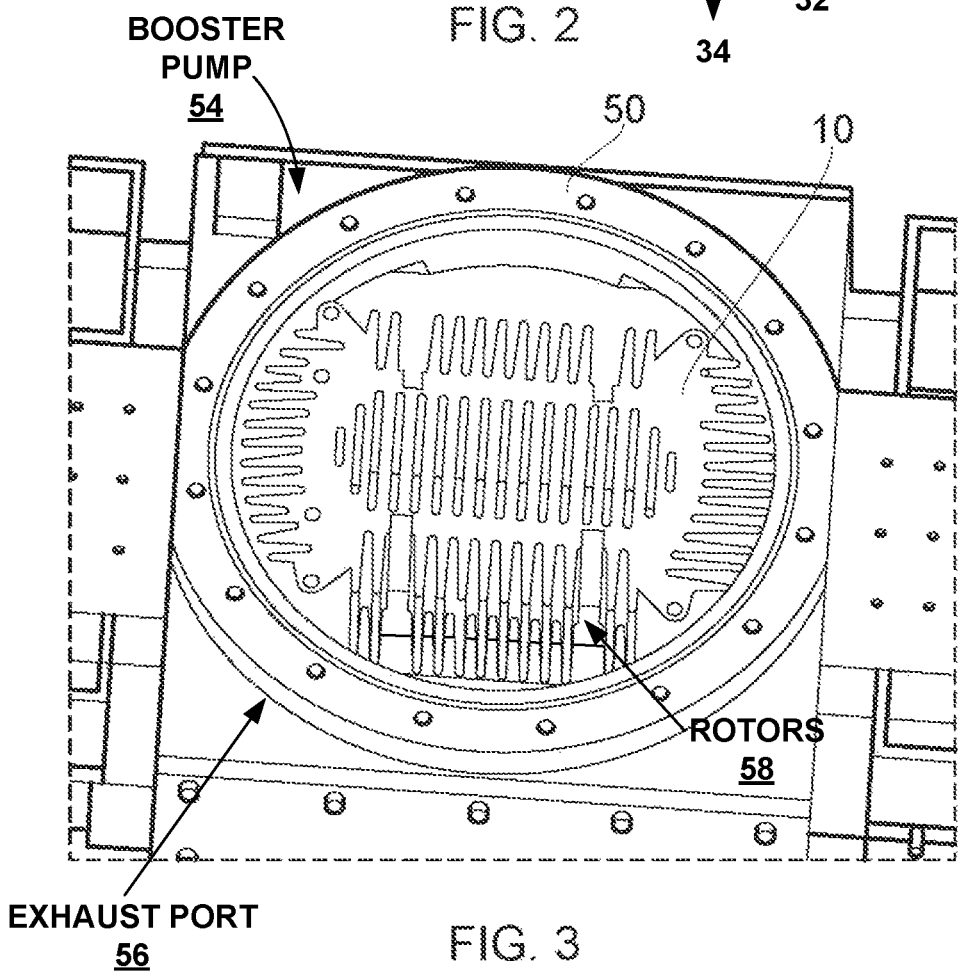
FIG. 3 illustrates the heat exchanger mounted on the exhaust port of a booster pump according to an embodiment.

FIG. 2 shows the cast metal heat exchanger 10 of FIG. 1, with a mounting flange 50, via which is configured to be mounted to a port of a pump not shown in FIG. 2). FIG. 3 shows heat exchanger 10 mounted on the exhaust port 56 of a booster pump 54, whereby the block and fins of the heat exchanger 10 extend towards 52 the rotors 58 of the pump 54. The cast metal heat exchanger is designed to fit within the gas flow path 42 such that it extends across most of the flow path and the surface of the heat exchanger 10 closest to the rotor is configured to lie within 45 mm of the rotor not shown in FIG. 3).

Figure 4:
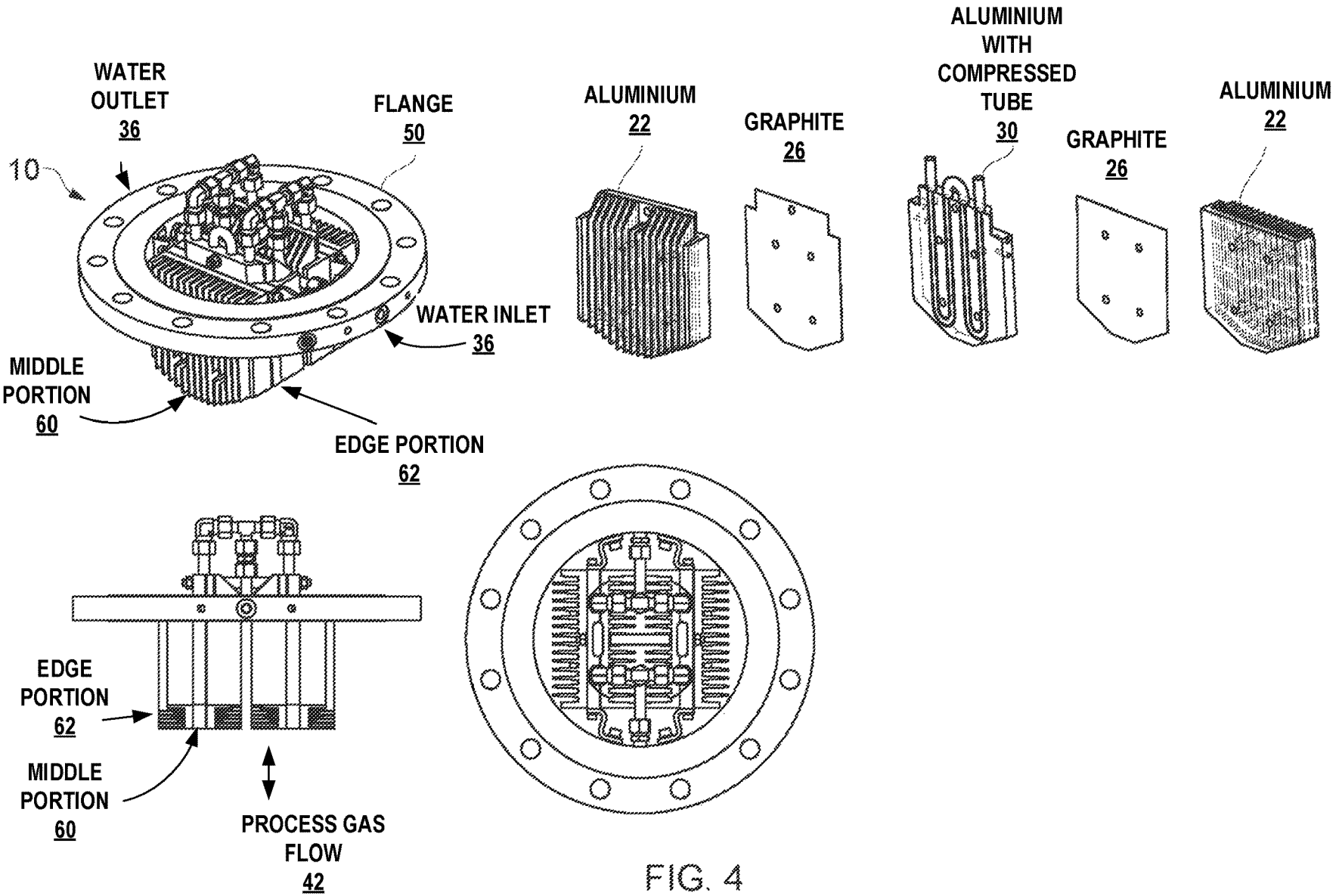
FIG. 4 shows a modular heat exchanger according to an embodiment.

FIG. 4 shows a modular heat exchanger 10 in the form of an aftercooler for a booster pump according to an embodiment. The heat exchanger 10 comprises a mating flange 50 configured to join with a vacuum booster exhaust. The flange 50 carries inlet 36 and outlet 38 channels for the input and output of fluid such as water as well as mounting points for the internal heat exchange components.

In this embodiment two custom designed aluminium cooling blocks are provided with pressed in copper tubing 30 configured to carry the cooling water from the main modules of the heat exchanger. In the modular figure only one is shown for ease of illustration. Shaped extruded finned aluminium heatsinks 22 are bolted to the two cooling blocks with intermediate thermally conductive film in the form of a thin graphite layer 26 lying between the modular components. The blocks and fins are specifically shaped to be in close proximity to the vacuum pump rotors knot shown in FIG. 4) to provide efficient thermal cooling of the gas and of the pump rotors when mounted on the exhaust port knot shown in FIG. 4). In this regard as can be seen from the figures, the lower surface of the heat exchanger that extends towards the rotors comprises a middle portion 60 which extends further than the edge portions 62. This middle portion 62 extends into the space between the rotors of the pump knot shown in FIG. 4) providing effective cooling of the rotors as well as the exhausted and recirculated gas. The formation of this aftercooler 10 from modular components allows it to be manufactured from modules simply fixed together in some way such as by bolting or welding. The modular nature of the device 10 means that at least some of the components may be standard off the shelf components, or at least have applications in multiple vacuum pump heat exchangers of slightly different configurations.

In this regard although in this embodiment there are two central blocks, two thin sheets of graphite 26 and two aluminium heat sinks 22, owing to the modular nature of this embodiment any number of different components may be used together according to the required size and application of the heat exchanger.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

The invention claimed is:

1. A vacuum booster pump comprising a modular heat exchanger for changing a temperature of a gas flow, the heat exchanger comprising:

at least one tube configured to contain a flow of fluid;

the at least one tube being at least partially embedded within a block of material, wherein the block is formed of a rigid, conductive material that holds and protects the at least one tube and conducts heat to the at least one tube;

at least one heatsink, wherein the heatsink is shaped extruded and finned and wherein the heatsink is separate from the block of material;

a thermally conductive material located between the heatsink and the block of material, the thermally conductive material is separate from the block of material and the heatsink, and wherein the heatsink is attached to the block of material and the thermally conductive material; and mounting means configured to mount the heat exchanger adjacent to a gas port of a pump such that a least a portion of the heat exchanger extends into a path for gas flow flowing through the gas port, wherein the mounting means comprises a flange, the flange being configured to connect with the gas port of the pump, the block being mounted to the flange such that the block extends towards at least one rotor of the pump when the flange is connected with the gas port of the pump.

2. The vacuum booster pump according to claim 1, wherein the heat exchanger is mounted centrally within the gas flow path when mounted adjacent to the gas port.

3. The vacuum booster pump according to claim 1, the heatsink comprises a plurality of heat transfer fins extending from the block, the plurality of heat transfer fins being configured to extend into the gas flow path when the heat exchanger is mounted adjacent to the gas port.

4. The vacuum booster pump according to claim 3, wherein the plurality of heat transfer fins extends towards the rotor of the pump when the flange is connected with the gas port of the pump.

5. The vacuum booster pump according to claim 3, wherein the block is mounted to the flange such that when mounted adjacent to the gas port of the pump, at least some of the plurality of heat transfer fins extend close to the at least one rotor of the pump, such that the at least some of the plurality of heat transfer fins are within 50 mm of the at least one rotor.

6. The vacuum booster pump according to claim 5, wherein the block is mounted to the flange such that when mounted adjacent to the gas port of the pump, at least some of the plurality of heat transfer fins extend to within 10 mm of the at least one rotor.

7. The vacuum booster pump according to claim 5, wherein the block is mounted to the flange such that when mounted adjacent to the gas port of the pump, at least some of the plurality of heat transfer fins extend to within 5 mm of the at least one rotor.

8. The vacuum booster pump according to claim 1, the heat exchanger comprising a plurality of heat transfer fins extending from the block, wherein the block and the plurality of heat transfer fins are shaped such that the block and the plurality of heat transfer fins extend further towards the at least one rotor towards a centre of the gas flow path than they do towards an edge of the gas flow path.

9. The vacuum booster pump according to claim 3, wherein the heat exchanger is configured to have substantially the same cross section perimeter as the gas port, wherein to have substantially the same cross section perimeter as the gas port, an outer perimeter of the heat exchanger is configured with a length that is 90% or more of the length of the perimeter of the gas port and adjacent to the gas flow path.

10. The vacuum booster pump according to claim 3, wherein said block and said plurality of heat transfer fins are formed of aluminium.

11. The vacuum booster pump according to claim 3, wherein the thermally conductive material comprises a sheet of graphite.

12. The vacuum booster pump according to claim 3, wherein the heat exchanger comprises a plurality of block modules with thermally conductive material between each block, the heatsink being attached to the plurality of block modules with thermally conductive material between the heatsink and the plurality of block modules.

13. The vacuum booster pump according to claim 1, wherein the mounting means comprises a fluid inlet and a fluid outlet for connecting to a fluid source.

14. The vacuum booster pump according to claim 1, wherein the heat exchanger comprises a cooler, and the flow of fluid comprises a flow of cooling fluid.

15. The vacuum booster pump according claim 3, the heat exchanger being mounted adjacent to a port of at least one stage of the vacuum booster pump such that the plurality of heat transfer fins from the heat exchanger extend into a flow of gas passing through the port.

16. The vacuum booster pump according to claim 15, wherein the heat exchanger comprises a cooler and the flow of fluid comprises a flow of cooling fluid, the heat exchanger is mounted adjacent to an exhaust of the vacuum booster pump.

17. The vacuum booster pump according to claim 16, wherein at least a portion of the gas is recirculated, the heat exchanger being arranged to provide cooling to both the exhausted and recirculated gas.

18. The vacuum booster pump of claim 1, wherein the block is a cast metal unit.

19. The vacuum booster pump of claim 1, wherein the vacuum booster pump is a Roots vacuum booster pump.

* * * * *